United States Patent [19]

Perkins

[11] 4,422,830

[45] Dec. 27, 1983

[54] PERFORMANCE OF A PIPELINE ADDITIVE INJECTION SYSTEM

[75] Inventor: Thomas K. Perkins, Dallas, Tex.

[73] Assignee: Atlantic Richfield Company, Los Angeles, Calif.

[21] Appl. No.: 330,113

[22] Filed: Dec. 14, 1981

[51] Int. Cl.[3] ..... F04F 5/12

[52] U.S. Cl. ..... 417/54; 417/87

[58] Field of Search ..... 417/87, 89, 84, 197, 417/53, 54

[56] References Cited

U.S. PATENT DOCUMENTS

| | | | |
|---|---|---|---|
| 2,571,932 | 10/1951 | Olsson | 417/87 |
| 2,789,510 | 4/1957 | Meynig | 417/402 |
| 3,043,107 | 7/1962 | Magnus | 417/87 X |
| 3,491,948 | 1/1970 | Alexander | 417/87 X |
| 3,551,073 | 12/1970 | Petrovits | 417/87 X |
| 4,181,469 | 1/1980 | Dion-Biro | 417/87 |

*Primary Examiner*—Edward K. Look

*Attorney, Agent, or Firm*—M. David Folzenlogen

[57] ABSTRACT

The suction side performance of an injection pump for pumping a viscous chemical liquid or semi-liquid additive into a liquid flowing in a pipeline is improved by simultaneously pumping a compatible low viscosity liquid into the line leading to the suction side of the injection pump. The low viscosity liquid acts as a lubricating fluid for the viscous additive and assists movement of the viscous additive to and through the injection pump. The combined action of the low viscosity liquid and injection pump may also assist solution or dispersion of the additive in the liquid flowing in the pipeline.

5 Claims, 1 Drawing Figure

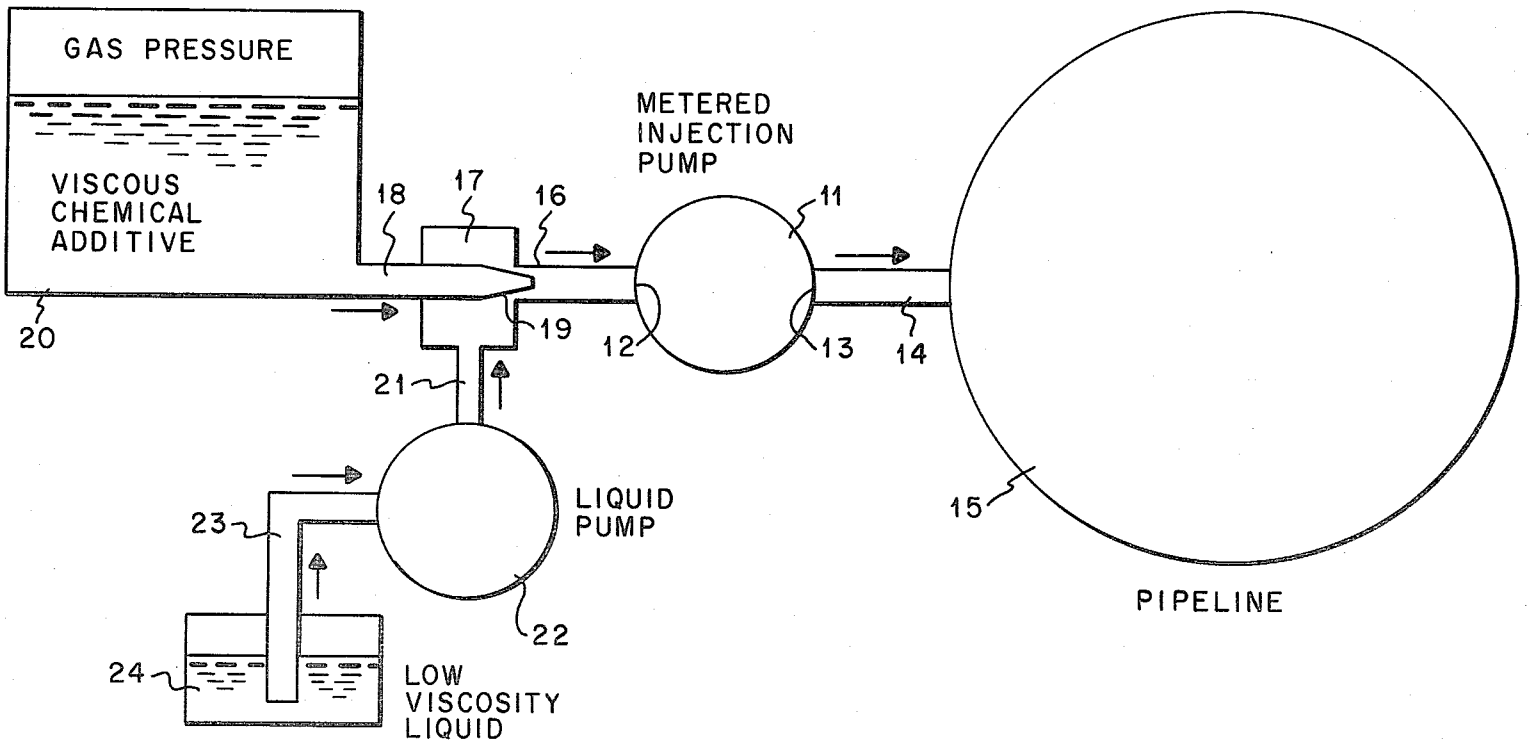
PIPELINE
15
14
13
11
METERED INJECTION PUMP
12
16
19
17
18
21
LIQUID PUMP
22
LOW VISCOSITY LIQUID
23
24
GAS PRESSURE
VISCOUS CHEMICAL ADDITIVE
20

PERFORMANCE OF A PIPELINE ADDITIVE INJECTION SYSTEM

BACKGROUND OF THE INVENTION

This invention relates to the metered injection of viscous chemical additives into a liquid flowing in a pipeline. More particularly, a compatible low viscosity liquid is used to assist the suction side of an injection pump.

There are many instances where a chemical additive is injected in a metered manner into a liquid flowing in a pipeline. For manufacturing, shipping, storage and other reasons, it is sometimes desirable to use a viscous liquid or semi-liquid additive, for example, injection of a viscous drag reduction agent into an oil pipeline. But the injection of a viscous additive creates several problems. Sometimes, it is difficult to pump a viscous additive with off-the-shelf pumps. When a special pump is required, there are the inherent problems for maintaining, repairing and replacing the pumps, especially in remote areas. Regardless of the type of pump used, it is difficult for the injection system to accurately measure and the pump to consistently inject the proper amount of a viscous additive.

One method of aiding the flow of a viscous additive is to use a gas pressurized container; but there are limits on the gas pressure that may be applied without rupturing the container and sometimes without interferring with the calibration of the metering pump.

The effectiveness of an additive usually depends on its solution or dispersion in the pipeline liquid in a relatively fast manner. The mixing forces caused by flow of the liquid in the pipeline are sometimes insufficient to solubilize or disperse the additive in the required time.

It is the purpose of this disclosure to provide a viscous additive injection system that increases the suction side efficiency of an additive injection pump and that may also assist in the rate of solution or dispersion of the additive in a pipeline liquid.

SUMMARY OF THE INVENTION

The suction side performance of an injection pump for pumping a viscous chemical liquid or semi-liquid additive into a liquid flowing into a pipeline is improved by simultaneously pumping a compatible low viscosity liquid into the line leading to the suction side of the injection pump. The low viscosity liquid acts as a lubricating fluid for the viscous additive and assists movement of the viscous additive to and through the injection pump. The combined action of the low viscosity liquid and injection pump may also assist solution or dispersion of the additive in the liquid flowing in the pipeline. The action of the low viscosity liquid is enhanced by causing the viscous liquid to discharge at a point in the inlet flowline leading to the suction side of the injection pump and pumping the low viscosity liquid around the discharge line for the additive. The compatible low viscosity liquid may be the same as the liquid flowed in the pipeline.

BRIEF DESCRIPTION OF THE DRAWING

The drawing is a schematic flow diagram of a pipeline injection system for a viscous additive wherein a low viscosity liquid is used to improve the suction side performance of an injection pump.

DETAILED DESCRIPTION OF THE PREFERRED EMBODIMENTS

The drawing illustrates the preferred arrangement for the improved viscous additive injection system of this disclosure. Accordingly, injection pump 11 has suction side 12 and discharge side 13 which is connected by way of suitable discharge piping 14 to the interior of pipeline 15 through which a liquid (not shown) is flowing. Metering injection pump 11 may be any sort of suitable variable output pump for handling a viscous liquid or semi-liquid chemical additive without degrading the additive or introducing undesirable materials, for example air, into the pipeline. The injection system will be adapted to meter and control the amount of fluid passing through injection pump 11. Typically, a gear pump will be used as such pumps do not require additional metering means.

Suction 12 of the injection pump is communicatively connected to one end of tubular inlet line 16. As shown, the other end of the inlet line is connected to optional enlarged chamber 17. The purpose of the enlarged chamber will hereafter be explained; but it is to be understood that the enlarged chamber is not necessary.

Extending into injection pump inlet line 16 is additive discharge or outlet line 18. If optional enlarged chamber 17 is used, outlet line 18 will also extend through the enlarged chamber and into inlet line 16. End 19 of outlet line 18 may be nozzle-shaped for reasons hereinafter made apparent. Outlet line 18 is communicatively connected to first or additive container 20 which contains a viscous liquid or semi-liquid chemical additive. If desired, the additive container may be gas pressurized in a manner such that the gas pressure pushes the additive downward toward outline line 18. A typical gas pressure is between 20 and 100 psig.

Communicatively connected to optional enlarged chamber 17 or to inlet line 16 at a point further from injection pump 11 than the discharge end of outlet line 18 is liquid pump discharge 21 which is communicatively connected to metering liquid pump 22. The suction side of liquid pump 22 is in turn communicatively connected by way of suction line 23 to second or low viscosity liquid container 24 which contains a compatible liquid having a substantially lower viscosity than the viscous additive in first container 20. The rate at which the low viscosity liquid is pumped will be adapted to meter and control the amount of compatible low viscosity liquid pumped into enlarged chamber 17. With this arrangement, it should be noted that the low viscosity liquid pump is adapted to pump liquid from second container 24 around the periphery of the discharge end of outlet line 18 and into inlet line 16. This peripheral flow arrangement of the low viscosity liquid is preferred.

For purposes of this disclosure, a low viscosity liquid is deemed compatible when the additive is at least partially soluble in the low viscosity liquid, and the low viscosity liquid will not contaminate the additive and the liquid flowing in pipeline 15, and will not interfere with the additive properly mixing with the liquid in the pipeline. Preferably, the low viscosity liquid will be miscible with the pipeline liquid and be of the same nature as the pipeline liquid.

In operation, as liquid is flowed through pipeline 15, a viscous liquid or semi-liquid chemical additive is pumped in metered fashion from additive container 20 which may be gas pressured. The additive flows through inlet line 16 to suction side 12 of injection pump 11 and thence through discharge side 13 through discharge piping 14 into the liquid flowing in pipeline 15. At the same time, the efficiency of the suction side of injection pump 11 is improved by injecting a compatible relatively low viscosity liquid from second container 24 into inlet line 16. Flow of the compatible low viscosity liquid assists flow of the viscous additive. The low viscosity liquid, therefore, may be thought of as a lubricating liquid for the suction side of injection pump 11. In order to assure injection of the proper amount of viscous additive into pipeline 15, injection pump 11 must be operated in a manner such that the rate of throughput of the injection pump exceeds the rate at which low viscosity liquid is pumped into inlet line 16.

Preferably, as shown, the viscous additive is flowed through outlet line 18 and this outlet line is terminated inside of inlet line 16. With this arrangement, the low viscosity liquid flows around at least a part of the periphery of outlet line 18. Optional enlarged chamber 17 is designed to assure peripheral flow of the low viscosity liquid around all of discharge end 19 of outlet line 18.

Reasonable variations and modifications are practical within the scope of this disclosure without departing from the spirit and scope of the claimed invention.

The embodiments of the invention in which an exclusive property or privilege is claimed are defined as follows:

1. In an additive injection method wherein a viscous chemical liquid in a container is pumped in a metered and controlled amount through an inlet line to the suction side of a metering injection pump and thence through the discharge side of said metering injection pump into a pipeline liquid flowing in a pipeline, the improvement comprising injecting a relatively low viscosity liquid into the said inlet line, said low viscosity liquid being compatible with said pipeline liquid, and operating said metering injection pump in a manner such that the rate of throughput of said metering injection pump exceeds the rate at which said low viscosity liquid is pumped into said inlet line and in a manner such that the amount of said chemical liquid pumped into said pipeline liquid is metered and controlled.

2. The method of claim 1 wherein said low viscosity liquid is the same type of liquid as said pipeline liquid.

3. The method of claim 1 wherein the viscous additive is flowed through an outlet line from said container and thence into said inlet line and said low viscosity liquid is pumped into said inlet line in a manner such that said low viscosity liquid flows around a part of said outline line of said container.

4. The method of claim 3 wherein said low viscosity liquid is the same type of liquid as said pipeline liquid.

5. An additive injection system for injecting a metered and controlled amount of a viscous chemical liquid into a liquid flowing in a pipeline comprising:

(a) a metering injection pump having a suction side and a discharge side;

(b) a discharge line communicatively connecting said discharge side of said injection pump to the interior of said pipeline;

(c) a tubular inlet line communicatively connected to said suction side of said injection pump;

(d) a first liquid container;

(e) an outlet line communicatively connected to the interior of said first liquid container, said outlet line having a discharge end extending partially into said inlet line leading to said suction side of said injection pump;

(f) a second liquid container; and (g) a second pump adapted to pump liquid from said second container around the periphery of said discharge end of said outlet line and into said inlet line leading to said suction side of said injection pump.

* * * * *